US009789414B2

(12) United States Patent
Meng

(10) Patent No.: US 9,789,414 B2
(45) Date of Patent: Oct. 17, 2017

(54) SIMPLE, GLUE-FREE MOVABLE TRACK MODEL WITH DUAL-PIN STRUCTURE

(71) Applicant: Rui Ye Century (Shenzhen) Hobby Co., Ltd., Shenzhen (CN)

(72) Inventor: Yi Meng, Shenzhen (CN)

(73) Assignee: Rui Ye Century (Shenzhen) Hobby Co., Ltd., Shenzhen (CN)

( * ) Notice: Subject to any disclaimer, the term of this patent is extended or adjusted under 35 U.S.C. 154(b) by 0 days.

(21) Appl. No.: 15/214,455

(22) Filed: Jul. 20, 2016

(65) Prior Publication Data

US 2016/0325195 A1 Nov. 10, 2016

Related U.S. Application Data

(63) Continuation of application No. PCT/CN2014/072680, filed on Feb. 28, 2014.

(30) Foreign Application Priority Data

Jan. 21, 2014 (CN) ..... 2014 2 0037430 U

(51) Int. Cl.
*A63H 17/14* (2006.01)
*A63H 17/045* (2006.01)
*A63H 18/02* (2006.01)

(52) U.S. Cl.
CPC ..... *A63H 17/045* (2013.01); *A63H 17/14* (2013.01); *A63H 18/021* (2013.01)

(58) Field of Classification Search
CPC ... A63H 17/045; A63H 18/021; B62D 55/211
USPC ..... 446/433; 305/188, 191, 194, 196, 200, 305/202, 204; 57/9
See application file for complete search history.

(56) References Cited

U.S. PATENT DOCUMENTS 1,748,400 A * 2/1930 Sabin ..... B66C 3/125 212/262
1,760,423 A * 5/1930 Mallard ..... A63H 17/14 280/28.5
2,332,976 A * 10/1943 Saurer ..... B62D 55/211 305/160
2,533,556 A * 12/1950 Cayce ..... A63H 17/14 305/192
2,895,429 A * 7/1959 Baermann ..... B62D 55/265 105/77
3,188,150 A * 6/1965 Sandganger ..... B62D 55/211 305/159

(Continued)

*Primary Examiner* — Melba Bumgarner
*Assistant Examiner* — Joseph B Baldori
(74) *Attorney, Agent, or Firm* — Wayne & King LLC

(57) ABSTRACT

A simple, glue-free movable track model with a dual-pin structure comprises an intermediate connecting component (1), a track shoe (2), elastic pin bushes (58) and an auxiliary clamp, an elastic opening (50) is formed on a rotating shaft hole of the intermediate connecting component (1), and the intermediate connecting component (1) is spliced, in a snap-fit manner, with an intermediate rotating shaft (51) of the track shoe (2) through the elastic opening (50); back-off dowels (21) are arranged at the both ends of the track shoe (2) and are spliced with the elastic pin bushes (58) so that the elastic pin bushes (58) can be fit into the back-off dowels (21) and then securely engaged. The movable track model can realize one-time assembly, reduce manufacturing difficulty and improve manufacturing efficiency.

1 Claim, 3 Drawing Sheets

(56) References Cited

U.S. PATENT DOCUMENTS 3,357,750 A * 12/1967 Reynolds ..... B62D 55/205 305/189
3,467,446 A * 9/1969 Suss ..... B62D 55/211 305/201
3,582,156 A * 6/1971 Korner ..... B62D 55/211 305/198
3,721,476 A * 3/1973 Andersson ..... B60F 3/0015 305/162
3,772,825 A * 11/1973 Gagnon ..... A63H 17/12 172/811
3,869,825 A * 3/1975 Heberlein ..... A63H 17/045 124/52
4,105,259 A * 8/1978 Boucher ..... A63H 17/14 152/225 R
4,139,241 A * 2/1979 Huhne ..... B62D 55/211 305/188
4,141,599 A * 2/1979 Stolz ..... B62D 55/211 305/159
4,444,441 A * 4/1984 Parker ..... B62D 55/28 305/189
4,522,606 A * 6/1985 Goldfarb ..... A63H 31/00 446/433
4,583,792 A * 4/1986 Erlenmaier ..... B62D 55/32 305/204
4,700,992 A * 10/1987 Cory ..... B62D 55/211 305/51
4,765,694 A * 8/1988 Cory ..... B62D 55/211 305/164
4,838,623 A * 6/1989 Mineart ..... B62D 55/211 305/204
4,840,438 A * 6/1989 Cory ..... B62D 55/211 305/160
4,871,216 A * 10/1989 Cory ..... B62D 55/211 305/189
5,056,306 A * 10/1991 Zepf ..... B21K 23/02 305/191
5,069,510 A * 12/1991 Cory ..... B62D 55/211 305/202
5,135,427 A * 8/1992 Suto ..... A63H 17/14 180/6.7
5,484,321 A * 1/1996 Ishimoto ..... A63H 17/14 305/165
5,921,843 A * 7/1999 Skrivan ..... A63H 17/14 446/431
6,132,287 A * 10/2000 Kuralt ..... A63H 17/004 446/431
6,951,096 B2 * 10/2005 Maguire ..... B21K 23/02 269/104
7,100,353 B1 * 9/2006 Maguire ..... B21L 21/00 269/104
7,343,728 B1 * 3/2008 Cundari ..... B21L 21/00 59/35.1
7,409,817 B1 * 8/2008 Huang ..... B21L 21/00 29/243.53
7,591,705 B2 * 9/2009 Ciccarelli ..... A63H 19/15 238/10 R
7,703,863 B2 * 4/2010 Koolhiran ..... B62D 55/205 305/160
7,757,473 B2 * 7/2010 Fuse ..... B21L 9/065 100/292
7,797,920 B2 * 9/2010 Wang ..... B21L 9/065 29/243.53
8,141,333 B2 * 3/2012 Yu ..... B21L 9/065 29/243.53
8,544,253 B2 * 10/2013 Sevrette ..... B25B 27/22 269/43

* cited by examiner

SIMPLE, GLUE-FREE MOVABLE TRACK MODEL WITH DUAL-PIN STRUCTURE

CROSS-REFERENCE TO RELATED APPLICATIONS

This application is a continuation of International Patent Application No. PCT/CN2014/072680 with a filing date of Feb. 28, 2014, designating the United States, and further claims priority to Chinese Patent Application No. 201420037430.6 with a filing date of Jan. 21, 2014. The content of the aforementioned applications, including any intervening amendments thereto, are incorporated herein by reference.

FIELD OF THE INVENTION

The present application relates to the field of accessories of Armored Fight Vehicle (AFV) model, specifically to movable track mode with dual-pin structure of the AFV model.

BACKGROUND OF THE INVENTION

In the design of static AFV model, the movability of the track with dual pins is important. A movable track will significant improve the fidelity of the model. In the prior art, there are two kinds of the movable track with dual pins, one is made of metal and the other is made of PS (polystyrene). The metal track with dual pins is generally served as an additional item and will produced by specific company for additional items and the modeller can buy it herself/himself. In the model package, PS (polystyrene) material is usually used in the design and production of the track with dual pins.

The drawbacks of the combination of bumps and recessed holes or the combination of pin bushes and pins are as follows: the drawbacks of the combination of bumps and recessed holes are that the structure is not solid, the bumps for assembly are easily worn-out, the movability is not high, and it cannot simulate real dual-pin structure; the drawbacks of the combination of pin bushes and pins are that it is hard to combine them, it needs long manufacturing time, and it is easily broken or structurally damaged during coloring and hence causes assembly failure or breakage.

SUMMARY OF THE INVENTION

It is the objective of the present invention to provide a movable track apparatus for AFV model to simulate real track with dual pins.

In order to realize the above objective, a simple, glue-free movable track model with dual-pin structure is provided, which comprises an intermediate connecting component, a track shoe, elastic pin bushes, and an auxiliary clamp, wherein:

an elastic opening is formed on a rotating shaft hole of the intermediate connecting component, and the intermediate connecting component is spliced, in a snap-fit manner, with an intermediate rotating shaft of the track shoe via the elastic opening; back-off pins are arranged at both ends of the track shoe and are spliced with the elastic pin bushes so that the back-off pins can be fit into the elastic pin bushes and then securely engaged.

The auxiliary clamp comprises an upper auxiliary clamp, a lower auxiliary clamp and a third auxiliary clamp.

A locating pin is arranged on the upper auxiliary clamp, a locating hole corresponding to the locating pin is arranged on the lower auxiliary clamp, and the locating pin is fit into the locating hole to secure the upper auxiliary clamp and the lower auxiliary clamp.

Compared with the prior art, the advantages of the present invention are as follows:

(1) It adopts real dual pins (to simulate the effect of real track with dual pins) and it is glue-free.

(2) TPE (Thermoplastic Elastomer) material is used to make the pin bushes of the track. It thoroughly solves the problem of breakage and structural damage when small pins are engaged with pin bushes in the prior art by taking the advantages of the good extensibility and flexibility of the TPE (Thermoplastic Elastomer) material. The movability and structure when the track is connected is almost the same as that of real track, which improves the fidelity of the track of static AFV model to a new high level.

(3) The specifically designed auxiliary clamp will significantly reduce assembly difficulty and improve assembly efficiency.

BRIEF DESCRIPTION OF THE DRAWINGS

The present invention will be further described in the following with reference to the accompanying drawings and in combination with the embodiments.

DETAILED DESCRIPTION OF THE PREFERRED EMBODIMENT

Figure 1:
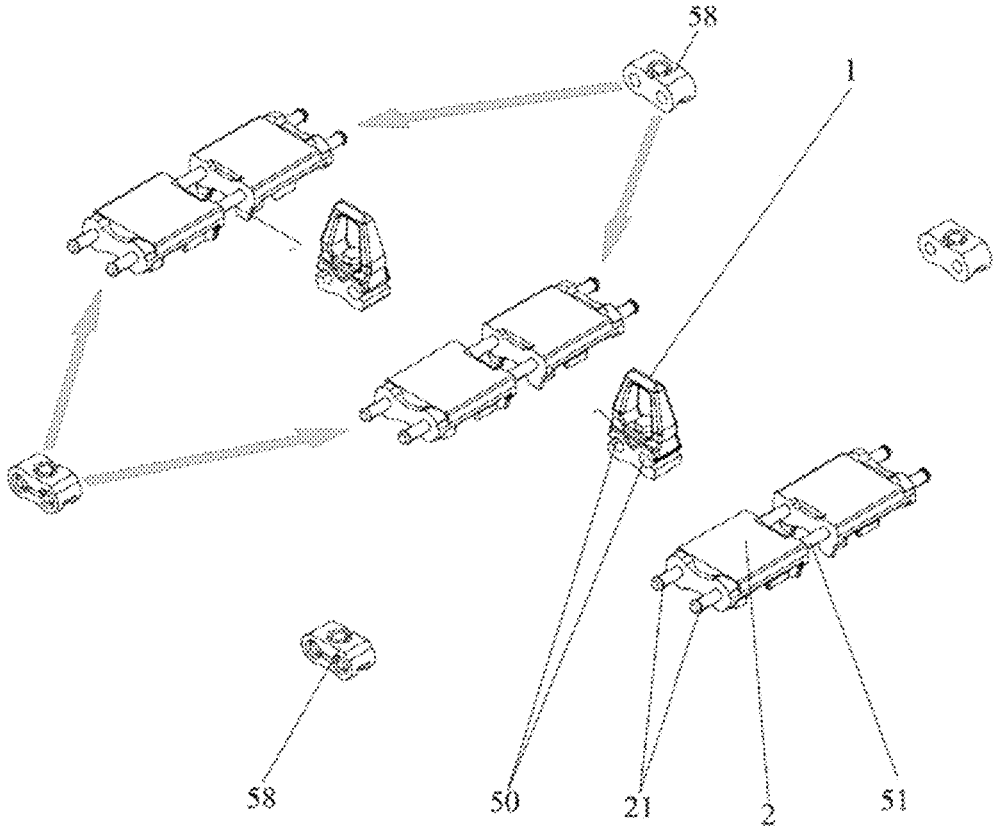
FIG. 1 is an assembling view of a track according to a preferred embodiment of the present invention.

Referring to FIG. 1, an intermediate connecting component 1 and a track shoe 2 are shown in FIG. 1. An elastic opening 50 is formed on a rotating shaft hole of the intermediate connecting component 1, and is bit with an intermediate rotating shaft 51. Namely, the intermediate rotating shaft 51 is bit within the elastic opening 50, which functions to connect the intermediate connecting component 1 with the track shoe 2. The intermediate connecting component 1 and the track shoe 2 are made of PS (polystyrene) material, and are assembled in groups of six.

Back-off pins 21 are arranged at both ends of the track shoe 2 and are spliced with elastic pin bushes 58 so that the back-off pins 21 can be fit into the elastic pin bushes 58 and then securely engaged.

An auxiliary clamp comprises an upper auxiliary clamp 52, a lower auxiliary clamp 53 and a third auxiliary clamp 57.

Figure 2:
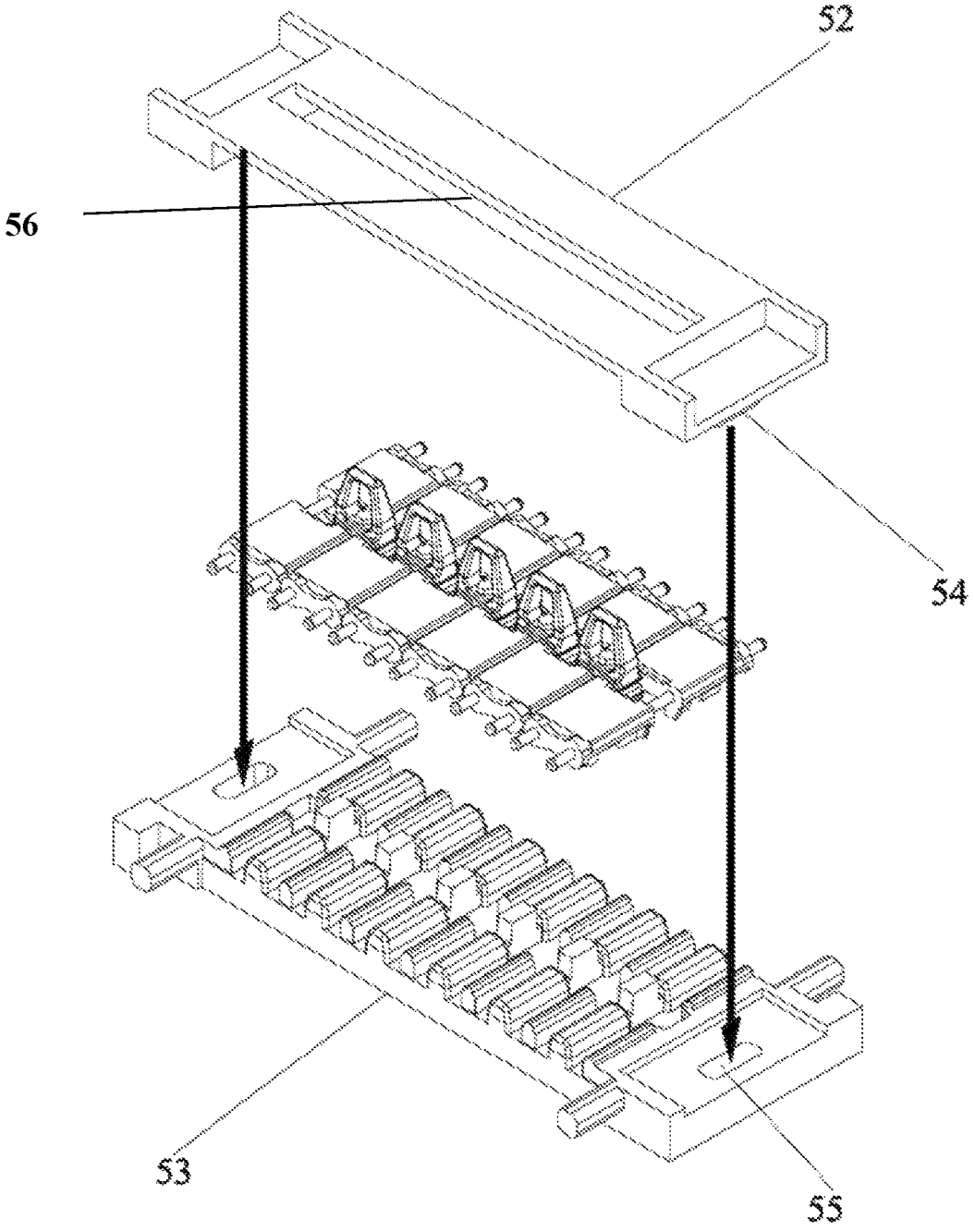
FIG. 2 is schematic view of an upper auxiliary clamp and a lower auxiliary clamp according to a preferred embodiment of the present invention.

As shown in FIG. 2, the intermediate connecting component 1 and the track shoe 2 are fixed between the upper auxiliary clamp 52 and the lower auxiliary clamp 53. An elongate opening 56 is defined on the upper auxiliary clamp 52 for receiving intermediate connecting components 1. A locating pin 54 is arranged on the upper auxiliary clamp 52, a locating hole 55 corresponding to the locating pin 52 is arranged on the lower auxiliary clamp, and the locating pin 54 is fit into the locating hole 55 to secure the upper auxiliary clamp 52 and the lower auxiliary clamp 53.

Figure 3:
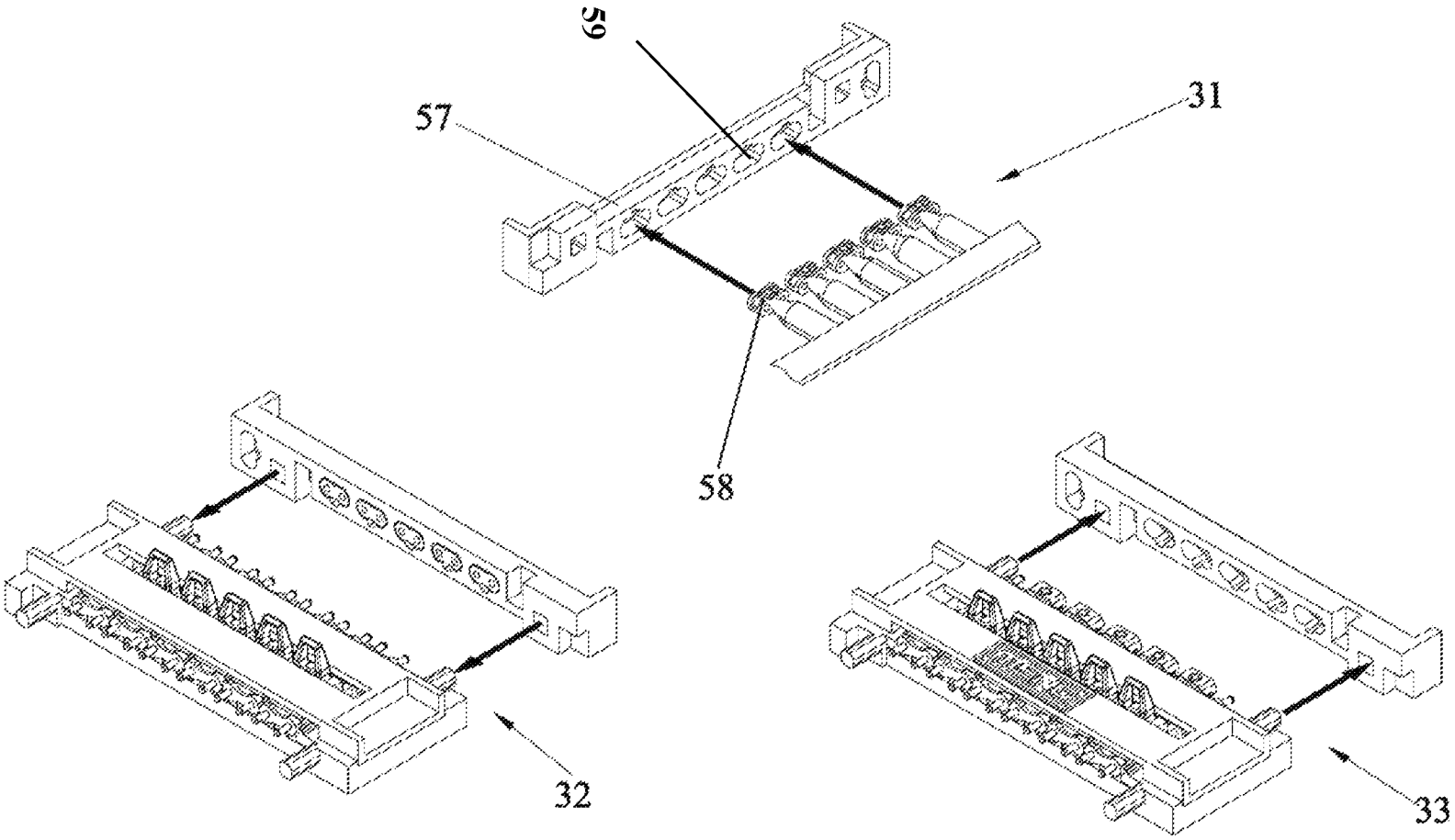
FIG. 3 is a schematic view showing assembling steps of the track according to a preferred embodiment of the present invention.

As shown in step 31 of FIG. 3, the elastic pin bushes 58 made of TPE (Thermoplastic Elastomer) material is ranged in a runner according to the distance and location of the back-off pins 21 on the track shoe 2. As shown in step 32 of FIG. 3, it is placed in the model holes 59 of the third auxiliary clamp 57 when assembling, and then the runner is cut. As shown in step 33 of FIG. 3, the third auxiliary clamp 57 loaded with the elastic pin bushes 58 makes the five elastic pin bushes receive the back-off pins 21 of the track shoe 2 all at once along the guide rod of the lower auxiliary clamp 53.

The above mentioned form, structure and the idea of their combination, realize a simple, glue-free movable track model simulating real dual-pin track structure. While the present invention discloses the specific implementations in above mentioned embodiments, the present invention is not limited to the scope described in above embodiments. Any modification or variation made without breaking away from the spirit and scope of the present invention also belongs to the protection scope of the present invention.

I claim:

1. A simple, glue-free movable track model with a dual-pin structure, comprising intermediate connecting components, track shoes, elastic pin bushes, and an auxiliary clamp assembly;

wherein an elastic opening is formed on a rotating shaft hole of the intermediate connecting components, and the intermediate connecting components are spliced, in a snap-fit manner, with intermediate rotating shafts of the track shoes via the elastic opening; back-off pins are arranged at both ends of the track shoes and are spliced with the elastic pin bushes so that the back-off pins can be fit into the elastic pin bushes and then securely engaged;

wherein the auxiliary clamp assembly comprises an upper auxiliary clamp, a lower auxiliary clamp and a third auxiliary clamp; locating pins are defined at both ends of the upper auxiliary clamp, locating holes corresponding to the locating pins are defined at both ends of the lower auxiliary clamp, and the locating pins are engaged with the locating holes with an interference fit to secure the track shoes placed between the upper auxiliary clamp and the lower auxiliary clamp; the track shoes are horizontally connected together by the intermediate connecting components; an elongate opening is defined on the upper auxiliary clamp for receiving the intermediate connecting components; a plurality of model holes are defined in the third auxiliary clamp for loading the elastic pin bushes respectively and the elastic pin bushes are engaged with the back-off pins all at once via the third auxiliary clamp.

* * * * *